US006707251B2

(12) United States Patent
Chow et al.

(10) Patent No.: US 6,707,251 B2
(45) Date of Patent: Mar. 16, 2004

(54) FLASH DISCHARGE LAMP

(76) Inventors: Shing Cheung Chow, 1 C/D Young Ya Industrial Building, 381-389 Sha Tsui Road, Tsuen Wan (HK); Lap Lee Chow, 1 C/D Young Ya Industrial Building, 381-389 Sha Tsui Road, Tsuen Wan (HK)

( * ) Notice: Subject to any disclaimer, the term of this patent is extended or adjusted under 35 U.S.C. 154(b) by 24 days.

(21) Appl. No.: 10/084,197

(22) Filed: Feb. 28, 2002

(65) Prior Publication Data

US 2002/0135299 A1 Sep. 26, 2002

(30) Foreign Application Priority Data

Mar. 23, 2001 (CN) ..... 01208959 U

(51) Int. Cl.[7] ..... H01J 17/44; H01J 17/24; H01J 1/02

(52) U.S. Cl. ..... 313/594; 313/558; 313/595; 313/601; 313/234; 313/581; 313/42; 313/39

(58) Field of Search ..... 313/594–604, 313/558, 562, 607, 234, 581, 19, 20, 28, 39, 42, 553, 559

(56) References Cited

U.S. PATENT DOCUMENTS

| | | | | | |
|---|---|---|---|---|---|
| 2,087,735 | A | * | 7/1937 | Pirani et al. | 313/42 |
| 3,727,089 | A | * | 4/1973 | Chow | 315/238 |
| 3,930,176 | A | * | 12/1975 | Panico | 313/625 |
| 3,968,392 | A | * | 7/1976 | Buchta et al. | 313/594 |
| 4,303,846 | A | * | 12/1981 | Kimura et al. | 313/558 |
| 4,315,187 | A | | 2/1982 | Chow | |
| 5,256,935 | A | * | 10/1993 | Dobashi et al. | 313/491 |
| 5,838,104 | A | * | 11/1998 | Rutan et al. | 313/560 |
| 5,856,726 | A | * | 1/1999 | Evans et al. | 313/491 |
| 5,982,097 | A | * | 11/1999 | Mehrotra et al. | 313/631 |

FOREIGN PATENT DOCUMENTS

| | | |
|---|---|---|
| DE | 2131887 | 1/1972 |
| GB | 1345408 | 1/1974 |
| JP | 62055622 | 3/1987 |
| JP | 1-38397 | 8/1989 |
| JP | 2-47674 | 10/1990 |
| JP | 3-30259 | 4/1991 |

* cited by examiner

*Primary Examiner*—Nimeshkumar D. Patel
*Assistant Examiner*—German Colón
(74) *Attorney, Agent, or Firm*—Rabin & Berdo, P.C.

(57) ABSTRACT

A flash discharge lamp includes a pair of electrodes i.e. an anode and a cathode, oppositely disposed in at both ends of the glass bulb. An electro-conductive member is provided on the outer surface of the glass tube. A triggering electrode is mounted on the cathode and electrically connected to the electro-conductive member. Xenon gas is sealed in the glass tube. The flash discharge lamp further includes at least one High Temperature Resistant electrode mounted on the cathode and at least one Getter electrode mounted on the cathode and/or the anode. Not only can the above design increase the discharge output power and the discharge frequency, but it also extends the life expectancy of the flash discharge lamp.

30 Claims, 2 Drawing Sheets

FLASH DISCHARGE LAMP

The present invention relates to a flash discharge lamp having high power, high discharge frequency, and a long life expectancy.

BACKGROUND OF THE INVENTION

FIG. 1 shows the interior structure of an embodiment of a flash discharge lamp commonly used in photographic cameras. It comprises a glass tube 11; a pair of electrodes, i.e., an anode 12 and a cathode 13, oppositely disposed in at both ends of said glass bulb; a electro-conductive member 14 is provided on the outer surface of the glass tube; a electrode 15 and a triggering electrode 18 mounted on the cathode 13 and xenon gas sealed in said glass tube, wherein the triggering electrode 18 is electrically connected to said electro-conductive member 14. In operation, when an operating voltage is applied between the two electrodes 12 and 13, a trigger coil is activated to apply a high trigger voltage to the xenon gas, which is then electro-ionized. Under the action of the field formed between the two electrodes, ions and electrons are accelerated and come into collision with each other so that an electron avalanche effect is created. While all the xenon gas is nearly ionized and a high temperature is produced, a high temperature plasma is formed in the glass tube and emits bright light, which comes close to sunlight, in a short period of time.

The flash discharge lamp undergoes high temperature with each flash. Physical and chemical reactions occur over each component so that the electrodes in the tube become yellow gradually and the brightness decreases gradually.

In the photographic industries, the general life expectancy requirement of a stroboscopic discharge lamp is 3,000 flashes with a flash interval of 15 seconds, where skipping is not allowed. Light output of the flashes cannot be lower than 10% of its original specification before the life ends. In general, the flash discharge lamp can meet the customer criteria. However, in recent years, the demand in the light output has been increased, which leads to an increase of the input power, the discharge temperature of the emitted ions, and the duration of the discharge temperature of the flash discharge lamp. Moreover, as its application has been growing into safety alarms and emergency lighting systems, there is a substantial increase in technical requirement of discharge frequency and longer life span. With the current strobe manufacturing technology, after 15,000 continuous flashes, a sputtering black residue appears on the inner surface of the strobe, the brightness output decreases by more than 30%, blackening appears at the electrode ends and the center of the strobe becomes yellow. With the increase of the discharge frequency, the operational conditions of the flash discharge will go from bad to worse due to the discharge temperature and contamination incurred each flash.

It is an object of this invention to overcome the drawbacks of the prior art, and to provide a flash discharge lamp having the characteristic of higher output power with a longer life span.

Another object of this invention is to provide a flash discharge lamp having a higher discharge frequency.

SUMMARY OF THE INVENTION

To accomplish the foregoing objects, the present invention provides a flash discharge lamp comprising a pair of electrodes i.e. an anode and a cathode, oppositely disposed in at both ends of the glass tube, a electro-conductive member is provided on the outer surface of the glass tube, a triggering electrode mounted on said cathode and electrically connected to said electro-conductive member, and xenon gas sealed in said glass tube, characterized in that said flash discharge lamp further includes at least one high temperature resistant electrode mounted on said cathode and at least one getter electrode mounted on said cathode and/or said anode.

By use of the flash discharge lamps according to this invention, the light output can be multiplied 3 to 10 times. In another words, it can increase the total luminous flux by 3 to 10 times, and the unilateral luminous intensity by 1 to 3 times. The life expectancy of the said lamp is extended by 0.5 to 4 times and up to 10 million times. Moreover, the application of the flash discharge lamp according to this invention has been extended to safety alarms and emergency lighting systems due to the increase in the discharge frequency.

BRIEF DESCRIPTION OF DRAWINGS

Preferred embodiments of the invention will now be described with the reference to the accompanying drawings, in which the reference numbers designate the corresponding parts therein. Other and further objects, features and advantages of the invention will become apparent from the following description.

DETAILED DESCRIPTION OF PREFERRED EMBODIMENTS

In the flash discharge lamp according to this invention, at least two electrodes are used which have different functions. One electrode, taken as a High Temperature Resistant electrode, is made of high temperature resistant rare metal with a certain activity and its alloy thereby enabling the said lamp to withstand high temperature ion flushes. Another electrode, taken as a Getter electrode, is made of a more active rare metal and its alloy thereby possessing a desirable purifying effect.

The High Temperature Resistant electrode is made of tantalum and tantalum alloy, niobium and niobium alloy, or vanadium and vanadium alloy. In these materials, tantalum and tantalum alloy has extremely high melting point and therefore can withstand extremely high temperature. Although its oxidation activeness is not as active as titanium and zirconium, it is similar to other active metals in the sense that it produces non-reversible oxide. It is therefore able to absorb impure oxidative gases. However, tantalum and tantalum alloys have a lower diffusion coefficient of oxygen, so it is difficult for oxidative material absorbed on the surface to permeate inwards thereby reducing its surface oxygenic concentration and thus limiting its ability to absorb oxygenic materials. Niobium and niobium alloys have a melting point of over 2400° C. and can withstand higher temperature. They are also more active and vigorous and have a higher diffusion coefficient compared to that of tantalum. Niobium, an in-expensive material, and its alloys can produce non-reversible materials after reacting with oxidation gas and therefore have a higher ability to absorb oxygenic material compared to that of tantalum. Vanadium and its alloy have a melting point at 1920° C., which is lower than tantalum, niobium or their alloys; nevertheless, it is the most active among the three materials. Therefore, vanadium and vanadium alloy are the materials in between those used to make High Temperature Resistant electrode and Getter electrode, and they are suitable for a flash discharge lamp with a low power output yet having certain purifying characteristics.

Titanium and its alloy, or Zirconium and its alloy, are highly active materials used for Getter electrodes. Under certain conditions, they can form a stable, non-reversible chemical compound after reacting with all kinds of gases. Furthermore, they have a relatively high diffusion coefficient against external atoms, thereby swiftly diffusing chemical compounds formed on the surface inwards, and rapidly cleaning the surface and maintaining the purifying function over a long time. According to the flash discharge lamp of this invention, the High Temperature Resistant electrode and the Getter electrode can be made of any combination of the above materials in order to achieve a better performance result.

Figure 1:
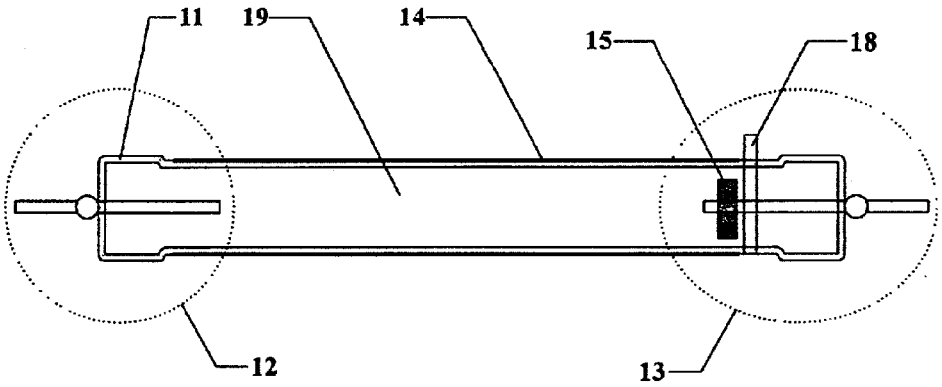
FIG. 1 Prior Art
FIG. 1 is a sectional side elevation of a flash discharge lamp according to prior art.
Figure 2:
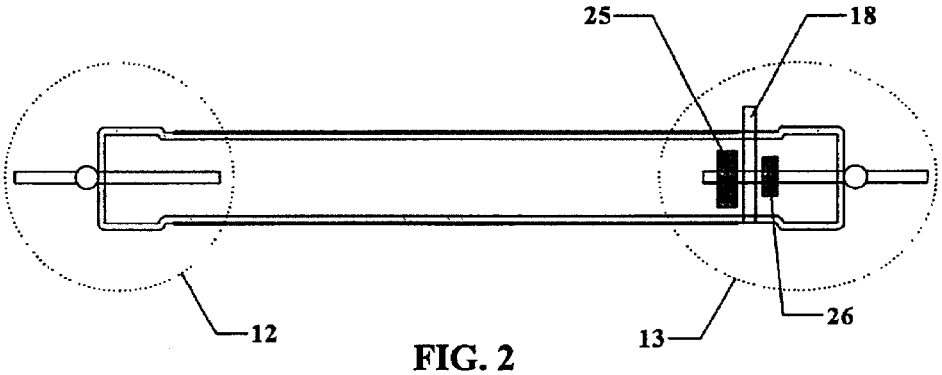
FIG. 2 is a sectional side elevation of first preferred embodiment of the flash discharge lamp according to this invention.

FIG. 2 is the first example of this invention, showing a structural diagram of a flash discharge lamp. A High Temperature Resistant electrode (25) made of tantalum alloy is affixed at the cathode (13) side (towards the anode side (12)) of the flash discharge lamp. A Getter electrode (26) made of titanium alloy is affixed at the cathode side (13) (towards the cathode side (13)) of the flash discharge lamp. The thickness of the tantalum alloy High Temperature Resistant electrode (25) and the titanium alloy Getter electrode (26) are 1.3 mm and 1.1 mm respectively. The operating voltage is 330V, triggering voltage is 4.5 kV, xenon gas pressure is 200–300 mmHg, and the main capacitor is 10 $\mu$F. With 3 flashes per second, the life span of the flash discharge lamp can sustain up to 1 million flashes.

Figure 3:
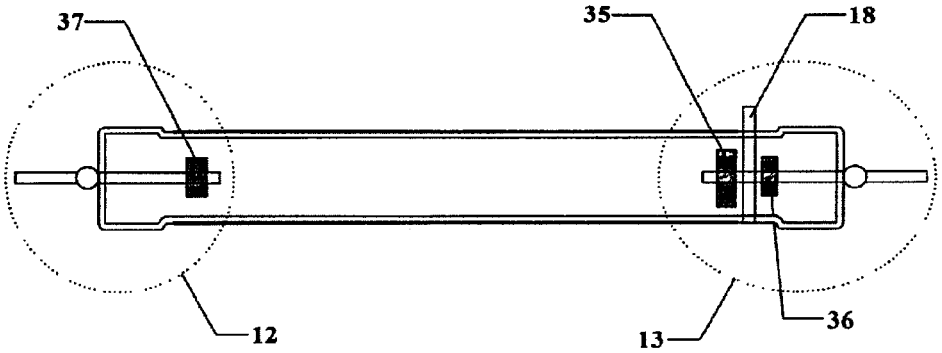
FIG. 3 is a sectional side elevation of second preferred embodiment of the flash discharge lamp according to this invention.

FIG. 3 is the second example of this invention, showing a structural diagram of a flash discharge lamp. A High Temperature Resistant electrode (35) made of tantalum alloy is affixed at the cathode (13) side (towards the anode side (12)) of the flash discharge lamp. A Getter electrode (36) made of zirconium alloy is affixed at the cathode side (13) (towards the cathode side (13)) of the flash discharge lamp. A second Getter electrode (37) made of titanium alloy is affixed at the anode side (12) of the flash discharge lamp. The thickness of the tantalum alloy High Temperature Resistant electrode (35), the zirconium alloy Getter electrode (36) and the titanium alloy getter electrode (37) are 1.3 mm, 1.1 mm and 1.1 mm respectively. The operating voltage is 472V, triggering voltage is 4.0 kV, xenon gas pressure is 350–450 mmHg, the main capacitor is 47 $\mu$F. With 8 flashes per second, the life span of the flash discharge lamp can sustain up to 10 million flashes.

Figure 4:
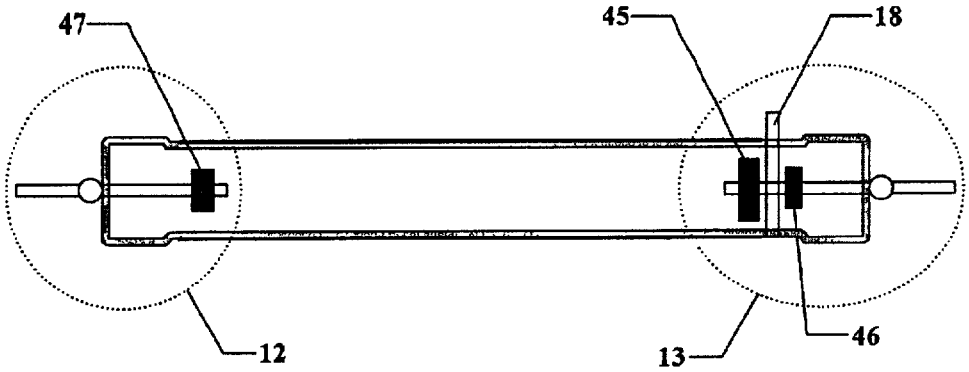
FIG. 4 is a sectional side elevation of third preferred embodiment of the flash discharge lamp according to this invention.

FIG. 4 is the third example of this invention, showing a structural diagram of a flash discharge lamp. A High Temperature Resistant electrode (45) made of niobium alloy is affixed at the cathode (13) side (towards the anode side (12)) of the flash discharge lamp. A Getter electrode (46) made of zirconium alloy is affixed at the cathode (13) side (towards the cathode side (13)) of the flash discharge lamp. A second Getter electrode (47) made of titanium alloy is affixed at the anode side (12) of the flash discharge lamp. The thickness of the niobium alloy High Temperature Resistant electrode (45), the zirconium alloy Getter electrode (46) and the titanium alloy Getter electrode (47) are 1.1 mm, 1.0 mm and 1.1 mm respectively. The operating voltage is 285V, triggering voltage is 4.5 kV, xenon gas pressure is 350–500 mmHg, the main capacitor is 100 $\mu$F. With one flash per second, the life span of the flash discharge lamp can sustain up to 1 million flashes, and the light output deteriorates less than 20%.

Figure 5:
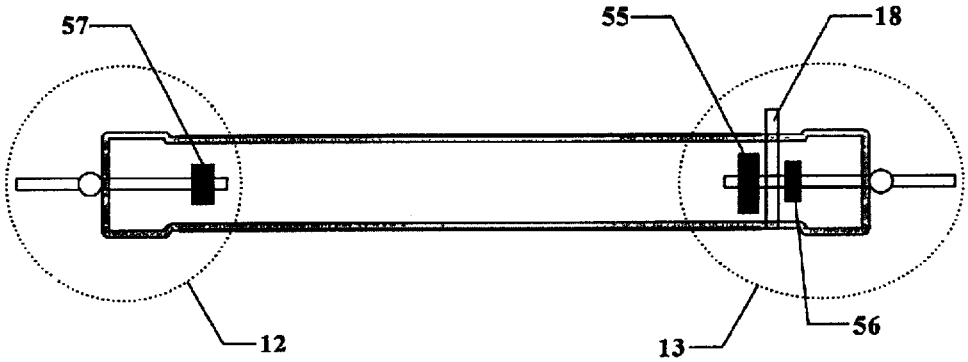
FIG. 5 is a sectional side elevation of forth preferred embodiment of the flash discharge lamp according to this invention.

FIG. 5 is the fourth example of this invention, showing a structural diagram of a flash discharge lamp. A High Temperature Resistant electrode (55) made of tantalum alloy is affixed at the cathode (13) side (towards the anode side (12)) of the flash discharge lamp. A Getter electrode (56) made out of titanium alloy is affixed at the cathode side (13) (towards the cathode side 13) of the flash discharge lamp. A second Getter electrode (57) made of vanadium alloy is affixed at the anode side 12 of the flash discharge lamp. The thickness of the tantalum alloy High Temperature Resistant electrode (55), the titanium alloy Getter electrode (56) and the vanadium alloy Getter electrode (57) are 1.3 mm, 1.1 mm and 1.1 mm respectively. The operating voltage is 210V, triggering voltage is 6.0 kV, xenon gas pressure is 400–500 mmHg, the main capacitor is 10 $\mu$F. With eight flashes per second, the life span of the flash discharge lamp can sustain up to 6 million flashes.

Figure 6:
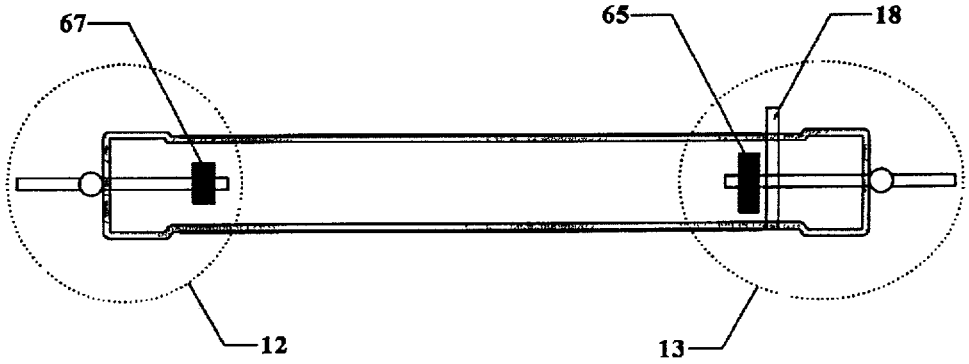
FIG. 6 is a sectional side elevation of fifth preferred embodiment of the flash discharge lamp according to this invention.

FIG. 6 is the fifth example of this invention, showing a structural diagram of a flash discharge lamp. A High Temperature Resistant electrode (65) made of tantalum alloy is affixed at the cathode (13) side (towards the anode side (12)) of the flash discharge lamp. A Getter electrode (67) made of titanium alloy is affixed at the anode side (12) of the flash discharge lamp. The thickness of the tantalum alloy High Temperature Resistant electrode (65) and the titanium alloy getter electrode (67) are 1.3 mm and 1.1 mm respectively. The operating voltage is 220V, triggering voltage is 5.0 kV, xenon gas pressure is 150–300 mmHg, the main capacitor is 3 $\mu$F. With eight flashes per second, the life span of the flash discharge lamp can sustain up to 10 million flashes.

The electrodes of the flash discharge lamp according to this invention are processed by the conventional practice of powder metallurgy. The High Temperature Resistant electrode and the getter electrode are composed of different kinds of metals, the percentages of such metal weightings distributed from the above examples are as follows:

1. Tantalum alloy: tantalum-niobium (or vanadium) 2–25%—titanium (or zirconium) 0.1–10%
2. Niobium alloy: niobium-tantalum (or vanadium) 2–25%—titanium (or zirconium) 0.1–10%
3. Vanadium alloy: vanadium-niobium (or tantalum) 2–25%—titanium (or zirconium) 0.1–10%
4. Titanium alloy: titanium-aluminum 0.5–4%—cerium, barium, calcium, cesium (small quantities)
5. Zirconium alloy: Zirconium-titanium 0.5–10%—aluminum 0.1–1%—cerium, barium, calcium, cesium (small quantities)

The operation of the flash discharge lamp according to this invention is analogous to that of the existing flash discharge lamp, but since at least two electrode attachments with High Temperature Resistance and purifying functions are being constructed on the cathode and anode, the forte of each electrode attachment can be brought into full play. As a result, the lamp's output power has been raised, the heat and contamination, which are caused by flashes, have been reduced more quickly and effectively, the discharge frequency has been increased and the lamp's life span has also been extended. Beyond question, these are only a few specific illustrations of achieving the best result of this invention by using electrode attachment of different materials and different arrangements. For example, the said Getter electrode can be made of the more common Nickel alloy; the said Tantalum alloy can be Tantalum-Titanium or Tantalum-Zirconium alloy; the said Niobium alloy can be Niobium-Titanium or Niobium-Zirconium alloy; the said Vanadium alloy can be Vanadium-Titanium alloy and so forth. Changes and variation in arrangements like these are also part of this invention.

What is claimed is:

1. A flash discharge lamp, comprising:

a tube with a light-transmitting wall, said tube having first and second ends and having an outer surface;

an anode electrode disposed at the first end of the tube;

a cathode electrode disposed at the second end of the tube;

an electro-conductive member provided on the outer surface of the tube;

a triggering electrode mounted on the cathode electrode and electrically connected to the electro-conductive member;

a high temperature resistant electrode mounted on the cathode electrode;

a getter electrode mounted on one of cathode and anode electrodes, the getter electrode being spaced apart from the high temperature electrode; and an inert gas sealed in the tube.

2. The flash discharge lamp according to claim 1, further comprising another high temperature resistant electrode affixed to the anode electrode.

3. The flash discharge lamp according to claim 2, wherein the high temperature resistant electrode is between the anode electrode and the triggering electrode.

4. The flash discharge lamp according to claim 2, wherein the triggering electrode is positioned between the getter electrode and the anode electrode.

5. The flash discharge lamp according to claim 2, wherein the high temperature resistant electrode is made of tantalum or tantalum alloy.

6. The flash discharge lamp according to claim 5, wherein the tantalum alloy is tantalum-niobium-titanium, tantalum-niobium-zirconium, tantalum-vanadium-titanium, tantalum-vanadium-zirconium, tantalum-titanium or tantalum-zirconium alloy.

7. The flash discharge lamp according to claim 2, wherein the high temperature resistant electrode is made of niobium or niobium alloy.

8. The flash discharge lamp according to claim 7, wherein the niobium alloy is niobium-tantalum-titanium, niobium-tantalum-zirconium, niobium-vanadium-titanium, niobium-vanadium-zirconium, niobium-titanium or niobium-zirconium alloy.

9. The flash discharge lamp according to claim 2, wherein the high temperature resistant electrode is made of vanadium or vanadium alloy.

10. The flash discharge lamp according to claim 9, wherein the vanadium alloy is vanadium-niobium-titanium, vanadium-niobium-zirconium, vanadium-tantalum-titanium, vanadium-tantalum-zirconium, vanadium-titanium or vanadium-zirconium alloy.

11. The flash discharge lamp according to claim 2, wherein the getter electrode is made of titanium or titanium alloy.

12. The flash discharge lamp according to claim 11, wherein the titanium alloy is titanium-aluminum-cerium, barium, calcium, or cesium alloy.

13. The flash discharge lamp according to claim 2, wherein the getter electrode is made of zirconium or zirconium alloy.

14. The flash discharge lamp according to claim 13, wherein the zirconium alloy is zirconium-titanium-aluminum-cerium, barium, calcium, or cesium alloy.

15. The flash discharge lamp according to claim 1, wherein the high temperature resistant electrode is positioned between the anode electrode and the triggering electrode.

16. The flash discharge lamp according to claim 1, wherein the triggering electrode is positioned between the electrode and the anode electrode.

17. The flash discharge lamp according to claim 1, wherein the high temperature resistant electrode is made of tantalum or tantalum alloy.

18. The flash discharge lamp according to claim 17, wherein the tantalum alloy is tantalum-niobium-titanium, tantalum-niobium-zirconium, tantalum-vanadium-titanium, tantalum-vanadium-zirconium, tantalum-titanium or tantalum-zirconium alloy.

19. The flash discharge lamp according to claim 1, wherein the high temperature resistant electrode is made of niobium or niobium alloy.

20. The flash discharge lamp according to claim 19, wherein the niobium alloy is niobium-tantalum-titanium, niobium-tantalum-zirconium, niobium-vanadium-titanium, niobium-vanadium-zirconium, niobium-titanium or niobium-zirconium alloy.

21. The flash discharge lamp according to claim 1, wherein the high temperature resistant electrode is made of vanadium or vanadium alloy.

22. The flash discharge lamp according to claim 21, wherein the vanadium alloy is vanadium-niobium-titanium, vanadium-niobium-zirconium, vanadium-tantalum-titanium, vanadium-tantalum-zirconium, vanadium-titanium or vanadium-zirconium alloy.

23. The flash discharge lamp according to claim 1, wherein the getter electrode is made of titanium or titanium alloy.

24. The flash discharge lamp according to claim 23, wherein the titanium alloy is titanium-aluminum-cerium, barium, calcium, or cesium alloy.

25. The flash discharge lamp according to claim 1, wherein the getter electrode is made of zirconium or zirconium alloy.

26. The flash discharge lamp according to claim 25, wherein the zirconium alloy is zirconium-titanium-aluminum-cerium, barium, calcium, or cesium alloy.

27. The flash discharge lamp according to claim 1, wherein the tube is a glass tube.

28. The flash discharge lamp according to claim 1, wherein the getter electrode is mounted on the cathode electrode.

29. The flash discharge lamp according to claim 28, further comprising another getter electrode that is mounted on the anode electrode.

30. The flash discharge lamp according to claim 1, wherein the inert gas is xenon.

* * * * *